US007584519B2

(12) United States Patent
Ouellette et al.

(10) Patent No.: US 7,584,519 B2
(45) Date of Patent: Sep. 8, 2009

(54) DISPOSABLE MITT OR GLOVE CONTAINING TREATMENT COMPOSITION

(75) Inventors: William Ouellette, Pleasanton, CA (US); Veronica Egan, Pleasanton, CA (US); Ron Heiskell, Pleasanton, CA (US); A. Akemi Ooka, Pleasanton, CA (US); Mondana Paymanian, Pleasanton, CA (US); Dale Spencer, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 241 days.

(21) Appl. No.: 10/457,096

(22) Filed: Jun. 5, 2003

(65) Prior Publication Data

US 2004/0244132 A1 Dec. 9, 2004

(51) Int. Cl.
*A47L 13/19* (2006.01)

(52) U.S. Cl. ..... 15/227; 15/104.93; 2/161.6

(58) Field of Classification Search ..... 15/104.93, 15/104.94, 227; 428/36.1, 35.1; 2/161.6, 2/167, 158, 159
See application file for complete search history.

(56) References Cited

U.S. PATENT DOCUMENTS

| | | | | | |
|---|---|---|---|---|---|
| 1,940,728 | A | * | 12/1933 | O'Connor | 401/7 |
| 1,994,425 | A | * | 3/1935 | Weller | 15/104.94 |
| 4,211,330 | A | * | 7/1980 | Strock | 206/581 |
| 4,303,543 | A | | 12/1981 | Mansy et al. | 252/117 |
| 4,683,001 | A | * | 7/1987 | Floyd et al. | 106/3 |
| 4,902,283 | A | | 2/1990 | Rojko et al. | 604/290 |
| 4,953,250 | A | | 9/1990 | Brown | 15/104.94 |
| 4,986,681 | A | | 1/1991 | Oliver | 401/7 |
| 4,987,632 | A | * | 1/1991 | Rowe et al. | 15/104.93 |
| 5,134,746 | A | | 8/1992 | William | 15/227 |
| 5,373,601 | A | | 12/1994 | Miller | 15/118 |
| 5,542,566 | A | | 8/1996 | Glaug et al. | 221/48 |
| 5,609,431 | A | | 3/1997 | Carroll | 401/201 |
| 5,649,336 | A | * | 7/1997 | Finch et al. | 15/104.94 |
| 5,829,089 | A | | 11/1998 | Steadman | 15/227 |
| 5,955,417 | A | | 9/1999 | Taylor | 510/438 |
| 5,979,007 | A | | 11/1999 | Soon | 15/227 |
| 6,012,195 | A | * | 1/2000 | Lindsay | 15/222 |
| 6,047,435 | A | * | 4/2000 | Suzuki et al. | 15/229.8 |
| 6,098,234 | A | | 8/2000 | Jackson, Jr. | 15/118 |
| 6,292,948 | B1 | | 9/2001 | Chen | 2/158 |
| 6,305,044 | B1 | | 10/2001 | James et al. | 15/227 |
| 6,376,046 | B1 | | 4/2002 | Hoshino et al. | 428/156 |
| 6,460,190 | B1 | | 10/2002 | Blum | 2/158 |
| 6,510,576 | B1 | * | 1/2003 | Gruber | 15/104.94 |

(Continued)

FOREIGN PATENT DOCUMENTS

EP 0066463 A1 12/1982

(Continued)

*Primary Examiner*—Laura C Guidotti
(74) *Attorney, Agent, or Firm*—Erin Collins

(57) ABSTRACT

A disposable mitt or glove for treating hard surfaces. The mitt or glove includes at least two layers and a treatment composition. The layers may be laminated, co-extruded, or otherwise attached. The outer layer is preferably nonwoven. The mitt or glove may be lined with tack points to control hand movement and may have an ultrasonically bonded cuff area. More particularly, the present invention relates to a disposable treatment mitt or glove and set of instructions for treating household surfaces or automobiles.

22 Claims, 4 Drawing Sheets

U.S. PATENT DOCUMENTS

| | | | | |
|---|---|---|---|---|
| 6,721,987 | B2 * | 4/2004 | McDevitt et al. | 15/227 |
| 6,811,338 | B1 * | 11/2004 | Manske et al. | 401/7 |
| 6,946,413 | B2 * | 9/2005 | Lange et al. | 442/327 |
| 2001/0047534 | A1 | 12/2001 | Sandusky | 2/158 |
| 2002/0000017 | A1 | 1/2002 | Brown et al. | 15/227 |
| 2003/0082966 | A1 * | 5/2003 | Menday et al. | 442/1 |
| 2003/0216281 | A1 * | 11/2003 | DeLeo et al. | 510/475 |
| 2003/0217425 | A1 * | 11/2003 | Datta et al. | 15/227 |
| 2004/0237234 | A1 * | 12/2004 | Young et al. | 15/104.94 |

FOREIGN PATENT DOCUMENTS

| | | | |
|---|---|---|---|
| EP | 0161911 | B1 | 11/1985 |
| EP | 0211664 | A1 | 2/1987 |
| EP | 0353014 | B1 | 1/1990 |
| WO | WO 97/38598 | | 10/1997 |
| WO | WO 98/26040 | | 6/1998 |
| WO | WO 00/74550 | | 12/2000 |
| WO | WO 02/44317 | | 6/2002 |

* cited by examiner

DISPOSABLE MITT OR GLOVE CONTAINING TREATMENT COMPOSITION

FIELD OF THE INVENTION

The present invention relates generally to a disposable mitt or glove for treating hard surfaces. The present invention relates generally to a disposable mitt or glove used for washing, polishing, waxing, or otherwise treating surfaces such as surfaces typically found in houses like kitchens, bathrooms, exterior house surfaces, or in car interiors or exteriors, e.g., floors, walls, tiles, windows, sinks, showers, shower curtains, wash basins, dishes, fixtures and fittings and the like made of different materials like ceramic, vinyl, no-wax vinyl, linoleum, melamine, glass, any plastics, plastified wood, metal or any painted or varnished or sealed surface and the like. These surfaces also include household appliances including, but not limited to, refrigerators, freezers, washing machines, automatic dryers, ovens, microwave ovens, dishwashers and so on. Car surfaces include the exterior body, interior and exterior windows, wheels, tires, and interior surfaces. The mitt or glove optionally contains a treatment composition selected from cleaning agents, shine agents, silicones, waxes, polishes, stain and soil repellents, lubricants, odor control agents, perfumes, fragrances and fragrance release agents, bleaching agents, drying agents, and rinsing agents. The mitt or glove may used with a hand or may be attached to a handle or other cleaning device. The mitt or glove may be lined and include tack regions to control hand movement and may be impregnated with a solid treatment composition. More particularly, the present invention relates to a disposable car wash mitt.

BACKGROUND OF THE INVENTION

U.S. Pat. No. 6,376,046 to Hoshino et al. discloses a cleaning article impregnated with detergent, where the article is composed of three layers with the interior layer being a detergent retaining layer and the exterior layers being detergent releasing layers. The detergent retaining layer is described as containing a low-density and a bulky hydrophobic material having a high retention capacity.

EP0353014 to Edwards et al. discloses solid surfactant between two layers of nonwoven, where the nonwoven is preferably of high loft cellulose fibers. U.S. Pat. No. 6,192,543 to Lee discloses a mitt with a dry liner of 4 mil poly plastic bag.

It is therefore an object of the present invention to provide a disposable cleaning mitt or glove for hard surfaces that overcomes the drawbacks and disadvantages that are often associated with conventional disposable cleaning mitts or gloves for hard surfaces.

SUMMARY OF THE INVENTION

1. In accordance with the above objects and those that will be mentioned and will become apparent below, one embodiment of the invention comprises a disposable mitt or glove for treating hard surfaces, comprising:
   a. an inner layer of water-permeable, water-impermeable or water-resistant material;
   b. an outer nonwoven layer having basis weight of less than 200 g per meter squared; and
   c. a treatment composition.
2. An additional embodiment of the invention comprises a disposable mitt or glove for treating hard surfaces, comprising:
   a. an inner layer of water-permeable, water-impermeable or water-resistant material;
   b. an outer nonwoven layer having basis weight of less than 200 g per meter squared;
   c. a treatment composition; and
   d. one or more tack regions.
3. An additional embodiment of the invention comprises a disposable mitt or glove for treating hard surfaces, comprising:
   a. an inner layer of water-permeable, water-impermeable or water-resistant material;
   b. an outer nonwoven layer having basis weight of less than 200 g per meter squared; and
   c. a treatment composition, wherein the treatment composition is approximately 1 to 20 g per 100 g of nonwoven.
4. An additional embodiment of the invention comprises a disposable mitt or glove for treating hard surfaces, comprising:
   a. an inner layer of water-permeable, water-impermeable or water-resistant material;
   b. an outer nonwoven layer having basis weight of less than 200 g per meter squared; and
   c. a treatment composition, wherein said mitt or glove has instructions for use on car surfaces, selected from a group comprising: exterior body, interior windows, exterior windows, wheels, interior surfaces or combinations thereof.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE INVENTION

Figure 2:
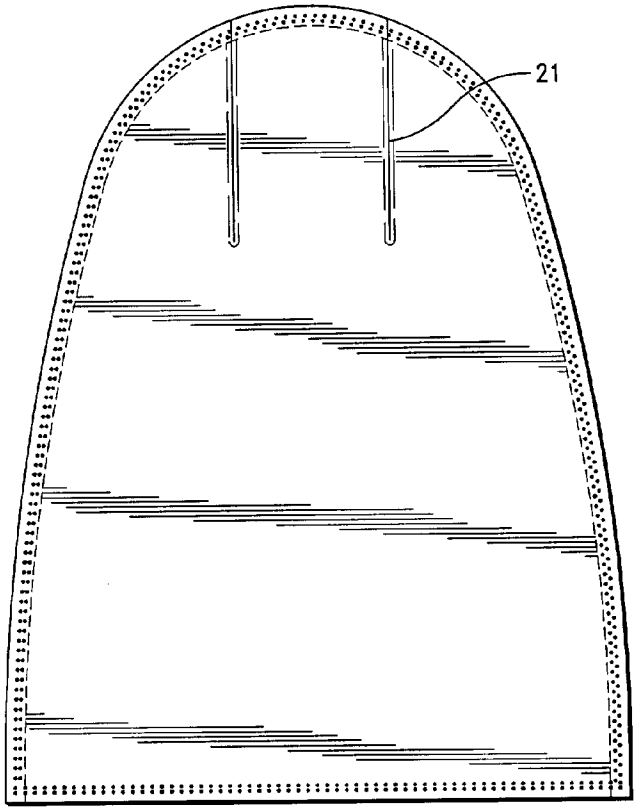
FIG. 2 is a top plan view of another embodiment of the invention.

Before describing the present invention in detail, it is to be understood that this invention is not limited to particularly exemplified systems or process parameters as such may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As will be appreciated by one having ordinary skill in the art, the disposable nonwoven mitt or glove of the invention substantially reduces or eliminates the disadvantages and drawbacks associated with prior art disposable cleaning mitts.

As used herein, "disposable" is used in its ordinary sense to mean an article that is disposed or discarded after a limited number of usage events, preferably less than 25, more preferably less than about 10, and most preferably less than about 2 entire usage events. As used herein, the term "mitt" refers to a covering for the hand having an enclosure that leaves some of the fingers within the same section of the enclosure. The mitt may include space for the thumb in the main enclosure, or provide space for the thumb in a separate enclosure for the thumb, or may not include a thumb enclosure at all. As used herein the term "glove" refers to a covering for the hand having separate sections for each finger.

Size and Shape

The inventive mitt may be formed with a separate thumb-receiving area or in a thumbless configuration, i.e., with a single cavity that receives a user's entire hand. In one embodiment of the invention, the mitt comprises an opening for inserting a hand therein, a section for the palm of the hand, a section for fingers, and a compartment for a thumb on either side of a central axis of the mitt, wherein the mitt may be used on either hand. In another embodiment, the mitt has at least two individual pockets, preferably two to four individual pockets, for the fingers of a user's hand and an opening to insert the user's hand. In another embodiment, the inventive glove has five individual pockets, for the fingers of a user's hand and an opening to insert the user's hand. In all embodiments, a handle or other cleaning device may be inserted into the mitt or glove instead of a hand.

Figure 1:
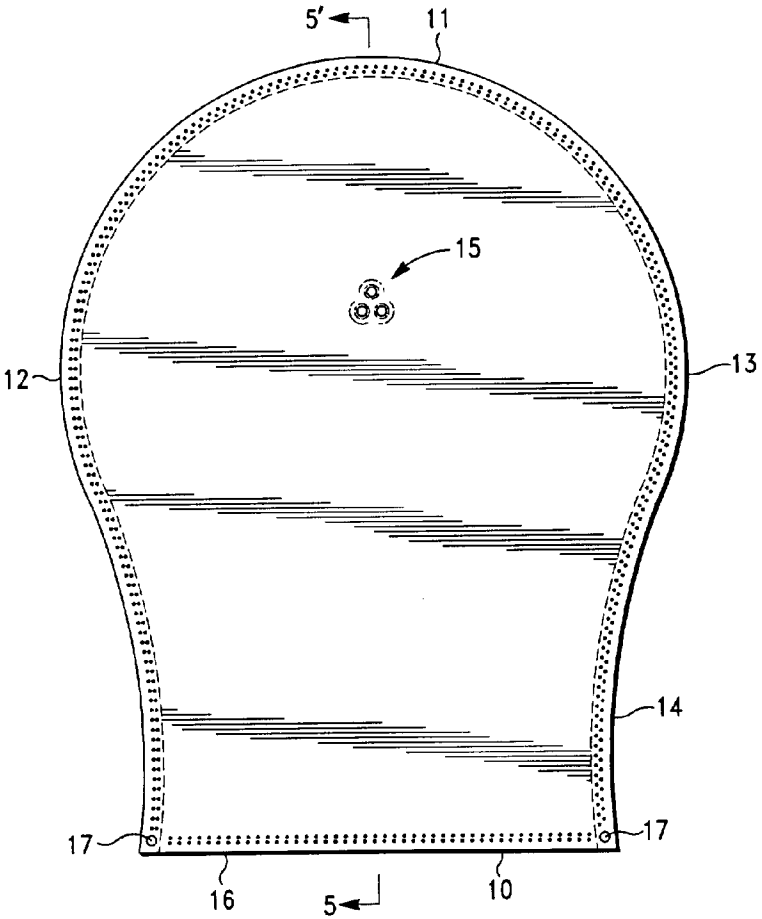
FIG. 1 is a top plan view of one embodiment of the invention.

In one embodiment, the mitt is narrowed at the wrist as shown in FIG. 1. The mitt may vary in size from 6 to 15 inches in length, preferably 10 to 12 inches in length, as measured between top end 11 and bottom end 10, and 3 to 12 inches in width, preferably 6 to 9 inches in width, as measured at the widest point from one side 12 to the other side 13. The mitt sides may be bonded together by a variety of means, including but not limited to adhesive (hot melt, latex, etc) bonding, ultrasonic bonding, pressure bonding, thermal bonding, and/or sewing, to form an outer seam 14.

Figure 4:
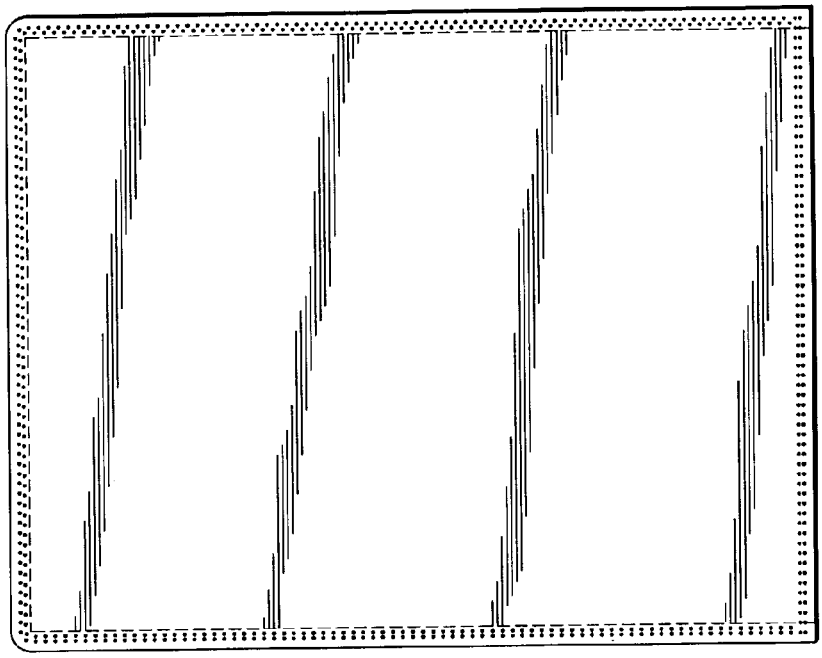
FIG. 4 is a top plan view of another embodiment of the invention.
Figure 3:
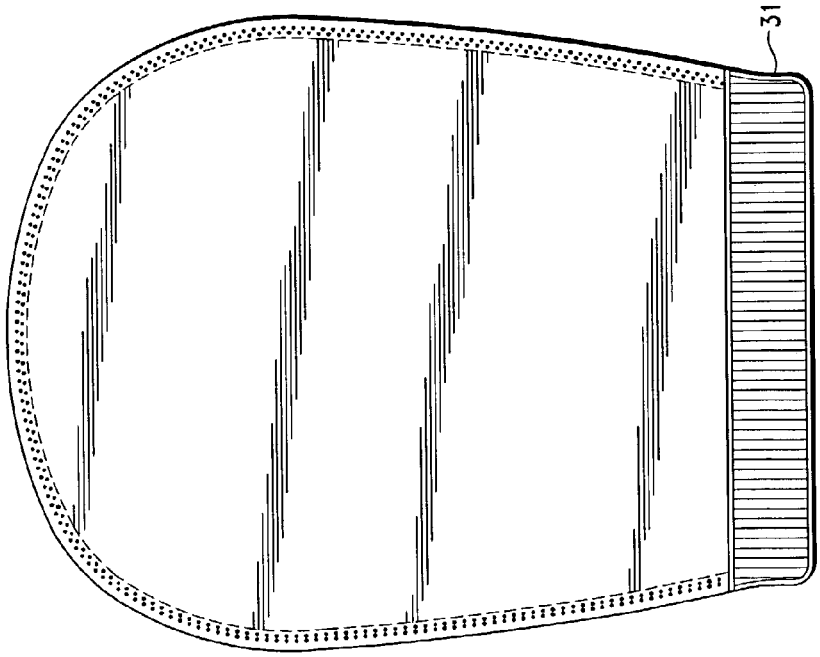
FIG. 3 is a top plan view of another embodiment of the invention.
Figure 6:
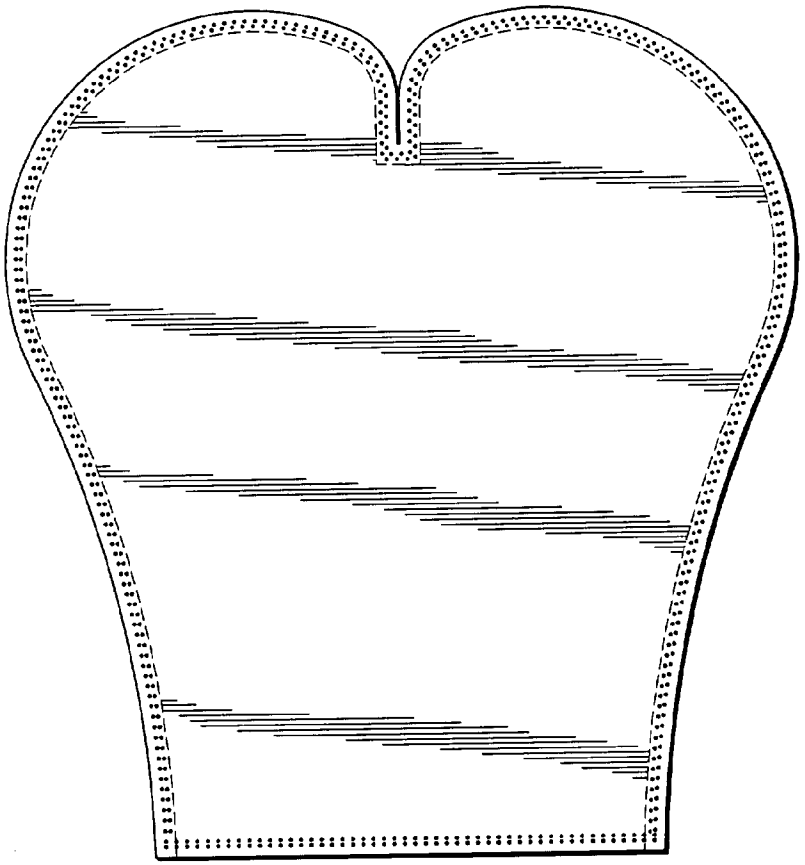
FIG. 6 is a top plan view of another embodiment of the invention.

In one embodiment of the invention, the mitt is flat and gently rounded, rectangular-shaped as shown in FIG. 2. In one embodiment, the mitt has a circular or oval shape with an opening for the user's hand as shown in FIG. 3. Optionally, the mitt comprises an elastic cuff member 31 adjacent the mouth and adapted to tightly encircle a users wrist when the user's hand is inserted into the mitt. The mitt may also be tightened at the wrist by Velcro™ or other means. In another embodiment, the mitt is rectangular or square as shown in FIG. 4. In another embodiment, the mitt's exterior shape is interrupted by one or more indentations as shown in FIG. 6.

Laminate Structure

Figure 5:
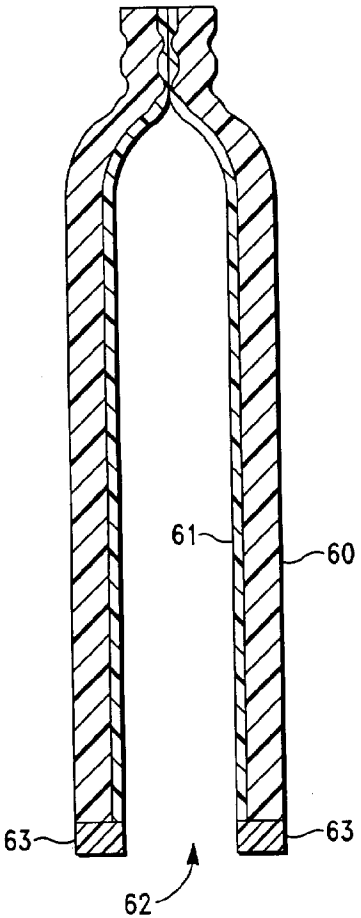
FIG. 5 is cross-sectional view of FIG. 1 taken along line 5-5' and viewed in the direction of the arrows.

In one embodiment, the inventive mitt or glove may consist of a single layer of water-permeable material. In another embodiment, the mitt or glove consists of two or more layers of material. The inventive mitt or glove preferably comprises two layers, as shown in FIG. 5, the first layer 60 being water permeable and a second layer 61 being water permeable, impermeable or water-resistant. The second layer 61 is located between the first layer 60 and the cavity 62 formed by the mitt. By cavity is meant herein, the inner space provided by the mitt envelope shape to fit the user's hand and/or a mechanical device, as for example a brush, broom, or the like. The first layer 60 is the outer layer. The second layer 61 is the inner layer. In another embodiment, the mitt or glove consists of three layers of material with a water resistant or water impermeable layer between the first layer and the second layer.

Figure 7:
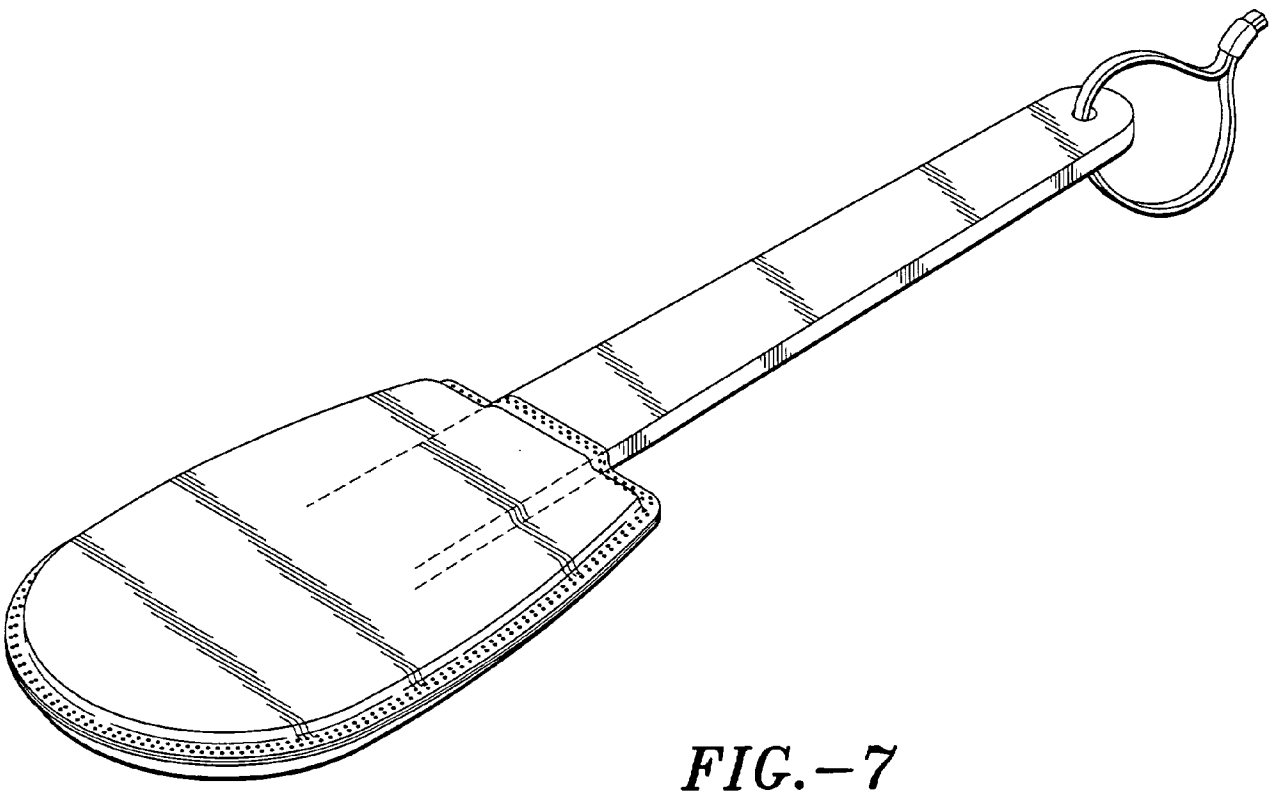
FIG. 7 is a top plan view of another embodiment of the invention.

In one embodiment, the inventive mitt or glove fits over a handle, as shown in FIG. 7.

Second Inner Layer

The inventive mitt or glove preferably contains an inner layer corresponding to the second layer 61 (FIG. 5) between the outer first layer 60 and the cavity 62. The inner layer may provide grip and control and may also increase the sudsing ability of the outer layer. In one embodiment, the inner layer is substantially water permeable. In one embodiment, the inner layer is substantially water impermeable or water-resistant. In a preferred embodiment, the inner layer is comprised of cellulosic material, polyethylene, polypropylene, polyethylene terephthalate (PET), or a blend of one or more of these materials. In a preferred embodiment, the inner layer is comprised of a blend of polyethylene terephthalate and cellulosic fiber or wood pulp. In a preferred embodiment, the inner layer is comprised of polyethylene terephthalate.

The inner layer is preferably attached to outer layer. The inner layer is preferably attached along the outer seam 14 (FIG. 1). The inner layer may also be attached at the tack portions 15 described herein or at the cuff area 16 or both. The inner layer is preferably coated onto the outer layer by extrusion coating or other means. A preferred inner layer is extrusion coated PET, extrusion coated polyethylene, or an extrusion coated blend of PET or polyethylene and cellulosic material.

The inner layer can be textured, e.g., having an embossed, scrim, or other structure to provide better hand feel. The feel of the inner layer can also be controlled by adjusting the water permeability of the layer.

Preferably, the inner layer comprises materials selected from the group consisting of synthetic nonwovens, cellulosic nonwovens, formed films, laminates, scrims, polymeric nets, and combinations thereof. Additionally, any natural or synthetic materials mentioned below as suitable for inclusion in the first outer layer may also be included in the inner layer.

First Outer Layer

The outer layer is preferably a nonwoven material. The outer layer is preferably a nonwoven material composed of hydrophilic fibers, hydrophobic fibers, or a mixture thereof. The outer layer preferably contains less than 50% hydrophilic fibers, such as cellulosic or modified cellulosic fibers. The outer layer more preferably contains less than 30% hydrophilic fibers, such as cellulosic or modified cellulosic fibers. Examples of the hydrophobic fibers are polyolefin fiber, such as polyethylene (PE) and polypropylene (PP); polyester fiber such as polyethylene terephthalate (PET); polyamide fiber such as nylon; polyacrylonitrile fiber, polyvinyl alcohol fiber, and mixtures thereof. Conjugated fibers comprising these fibers such as core/sheath type fiber and side-by-side type fiber can be also useful. The preferred fibers are polyethylene terephthalate.

The outer layer is preferably a low density, bulky hydrophobic material having low water absorbency. The outer layer may have a thickness of 0.2 to 10 mm (as measured using a Thwing-Albert Progage (500) thickness tester, foot diameter 2.221" and pressure 0.074 psi (0.5 kPa)). The outer layer preferably has a thickness of 1 to 8 mm and more preferably has a thickness of 2 to 6 mm. The outer layer preferably has a basis weight of 25 to 300 $g/m^2$, more preferably 75 to 160 $g/m^2$, and most preferably 90 to 125 $g/m^2$. The outer layer preferably has a density of 10 to 200 $g/m^3$, more preferably 15 to 100 $g/m^3$, and most preferably 20 to 60 $g/m^3$.

The outer layer preferably has a dry resiliency of 0 to 15%, more preferably 1 to 10%, and most preferably 2 to 6% (as measured by (thickness before compression minus thickness after compression) divided by (thickness before compression) times 100). The outer layer preferably has a wet resiliency of 0 to 15%, more preferably 1 to 10%, and most preferably 3 to 9% (after immersing in water and measured by (thickness before compression minus thickness after compression) divided by (thickness before compression) times 100). The outer layer preferably has an absorbency of 0 to 15%, more preferably 1 to 10%, and most preferably 2 to 8% (as measured by (original amount of water minus water remaining after layer immersion and removal) divided by (original amount of water) times 100).

Preferably, the outer layer comprises materials selected from the group consisting of cellulosic and non-cellulosic nonwovens, including foams, sponges, reticulated foams, laminates, scrims, polymeric nets, and combinations thereof. When the outer layer comprises fiber, the fibers can either be random (i.e., randomly aligned) or they can be carded (i.e., combed to be oriented in primarily one direction). Furthermore, the outer layer can be a composite material composed of a combination of additional layers, i.e., plies of random and carded fibers.

The outer layer may comprise a variety of both natural and synthetic fibers or materials. As used herein, "natural" means that the materials are derived from plants, animals, insects or byproducts of plants, animals, and insects. The conventional base starting material is usually a fibrous web comprising any of the common synthetic or natural textile-length fibers, or combinations thereof.

Nonlimiting examples of natural materials useful in the present invention include, but are not limited to, silk fibers, keratin fibers and cellulosic fibers. Nonlimiting examples of keratin fibers include those selected from the group consisting of wool fibers, camel hair fibers, and the like. Nonlimiting examples of cellulosic fibers include those selected from the group consisting of wood pulp fibers, cotton fibers, hemp fibers, jute fibers, flax fibers, and combinations thereof. Cellulosic fiber materials are preferred in the present invention.

Nonlimiting examples of synthetic materials useful in the present invention include those selected from the group consisting of acetate fibers, acrylic fibers, cellulose ester fibers, modacrylic fibers, polyamide fibers, polyester fibers, polyolefin fibers, polyvinyl alcohol fibers, rayon fibers, polyethylene foam, polyurethane foam, and combinations thereof. Examples of suitable synthetic materials include acrylics such as acrilan, creslan, and the acrylonitrile-based fiber, orion; cellulose ester fibers such as cellulose acetate, arnel, and acele; polyamides such as nylons (e.g., nylon 6, nylon 66, nylon 610, and the like); polyesters such as fortrel, kodel, and the polyethylene terephthalate fiber, polybutylene terephthalate fiber, dacron; polyolefins such as polypropylene, polyethylene; polyvinyl acetate fibers; polyurethane foams and combinations thereof. These and other suitable fibers and the nonwovens prepared therefrom are generally described in U.S. Pat. No. 4,891,227, to Thaman et al. and U.S. Pat. No. 4,891,228 to Thaman et al., each of which is incorporated by reference herein in its entirety.

Natural material nonwovens useful in the present invention may be obtained from a wide variety of commercial sources. Additional suitable nonwoven materials include, but are not limited to, those disclosed in U.S. Pat. Nos. 4,447,294 to Osborn; 4,603,176 to Bjorkquist and Schmidt; 4,981,557 to Bjorkquist; 5,085,736 to Bjorkquist; 5,138,002 to Bjorkquist; 5,262,007 to Phan and Hersko; 5,264,082 to Phan and Trokhan; 4,637,859 to Trokhan; 4,529,480 to Trokhan; 4,687,153 to McNeil; 5,223,096 to Phan and Trokhan and 5,679,222, issued to Rasch et al., each of which is incorporated by reference herein in its entirety.

Methods of making nonwovens are well known in the art. Generally, these nonwovens can be made by air-laying, water-laying, meltblowing, coforming, spunbonding, or carding processes in which the fibers or filaments are first cut to desired lengths from long strands, passed into a water or air stream, and then deposited onto a screen through which the fiber-laden air or water is passed. The resulting layer, regardless of its method of production or composition, is then subjected to at least one of several types of bonding operations to anchor the individual fibers together to form a self-sustaining web. In the present invention the nonwoven layer can be prepared by a variety of processes including, but not limited to, air entanglement, hydroentanglement, needlepunch, thermal bonding, and combinations of these processes. A preferred process is needlepunch.

The nonwoven layer may also be a polymeric sponge or mesh sponge as described in European Patent Application No. EP 702550B1 to Gordon et al., which is incorporated by reference herein in its entirety.

The outer layer may have two functional sides. Both sides may be identical in terms of materials and design or each side can be fabricated differently for a particular cleaning activity. These cleaning activities may include washing, polishing, waxing, buffing or otherwise treating surfaces.

Outer Seam

The outer seam 14 (FIG. 1) is formed by sealing the outside of the mitt or glove. The mitt or glove may be inverted so that the outer seam area is now on the inside. The outer seam is preferably about 0.05 to 0.5 inches wide, more preferably about 0.1 to 0.25 inches wide. The outer seam pattern may be discontinuous, such as dotted or slashed, or continuous. Preferred methods of forming the seam are disclosed herein.

Anchor Points

The inventive mitt or glove preferably contains one or more anchor points 17 (FIG. 1) in the seam area near the cuff. These anchor points provide stability to the seam, especially an ultrasonically bonded seam. The anchor points may be dots or circles, squares, triangles, or any other suitable shape. The anchor points preferably at there widest point comprise approximately 35 percent or greater of the seam width.

Cuff Seal

The inventive mitt or glove preferably contains a cuff seal 63 (FIG. 5). The cuff can be sealed in the same manner as the outer seam. If the inner liner layer is sufficiently attached to the outer cleaning layer, for example by coating, adhesive bonding, or coextrusion, then the cuff seal may not be necessary. Preferably the cuff seal is ultrasonically bonded.

Tack Regions

The inventive mitt or glove preferably contains one or more tack regions 15 (FIG. 1). Tack regions are preferably sealed on internal portions of the mitt to provide hand stability during use. The tack regions may be actual points, dots, or bonded lines. The tack region is preferably triangular bonded lines, triangular dots 15 (FIG. 1), or a single dot. These dots or lines are preferably internal and not reaching the edge of the mitt or glove as shown in FIG. 1. Optionally, these tack regions may extend to the outside of the mitt or glove 21 (FIG. 2). Tack regions have numerous utilities, but principally function to provide finger holds or areas of demarcation in the mitt without having to define finger or thumb areas or otherwise building border areas by more expensive processes. The tack areas allow for places to grip or securely position the mitt or glove on a user's hand.

Manufacturing Process

The articles of the present invention may optionally comprise binders. Binders or binding materials are useful for sealing the various layers of the present articles to one another thereby maintaining the integrity of the article. The binders may be in a variety of forms including, but not limited to, spray on, webs, separate layers, binding fibers, etc. Suitable binders may comprise latexes, polyamides, polyesters, polyolefins and combinations thereof. A partial description of useful manufacturing processes and bonding is given in U.S. Pat. Nos. 5,649,336 and 5,616,201 to Finch et al., which are incorporated by reference herein. Additional description of manufacturing processes are described in U.S. Pat. No. 6,508,602 to Gruenbacher et al., which is incorporated by reference herein. Suitable non-woven materials and manufacturing processes are described in U.S. Pat. No. 6,428,799 to Cen et al., which is incorporated by reference herein.

Examples of bonding the mitt or glove together on the outer seam, cuff area, or internally include, but are not limited to, heat bonding, ultrasonic bonding, pressure bonding, entangling by water or mechanical means (needling), sewing, gluing, etc. Preferred methods of bonding the mitt layers are ultrasonic bonding and heat bonding. The bonding can be a separate step or it can take place in the same step as cutting. A partial description of bonding types is given in U.S. Pat. No. 5,649,336 to Finch et al., which is incorporated by reference herein.

Treatment Compositions

The inventive mitt or glove optionally contains a treatment composition. The treatment compositions may be a liquid, solid, or gel. The treatment composition is preferably a solid or gel. The treatment composition comprises from 0.1% to 45% of the mitt or glove weight, preferably from 1% to 20% of the mitt or glove weight, and more preferably from 2% to 15% of the mitt or glove weight. The treatment composition may exist primarily on the inside of the outer layer (towards the inner layer), primarily on the outside of the outer layer, or relatively evenly distributed. The treatment composition preferably melts above 25° C., and more preferably above 35° C. The treatment composition preferably contains a dye, fragrance or other sensory elements. The treatment composition may contain any of the ingredients or adjuncts listed herein. The treatment composition may be applied by spraying, padding, dripping or any other suitable process with or without a drying step.

Surfactant

The components in accord with the invention and the compositions herein preferably contain one or more surfactants selected from anionic, nonionic, cationic, ampholytic, amphoteric and zwitterionic surfactants and mixtures thereof. A typical listing of anionic, nonionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Where present, ampholytic, amphotenic and zwitteronic surfactants are generally used in combination with one or more anionic and/or nonionic surfactants. The surfactants are preferably present at a level of from 0.1% to 15% of the mitt or glove weight, preferably from 1% to 8% of the mitt or glove weight, and more preferably from 2% to 6% of the mitt or glove weight.

The components in accord with the present invention and/or the detergent compositions herein may comprise an anionic surfactant. Essentially any anionic surfactants useful for detersive purposes can be comprised in the detergent composition. These can include salts (including, for example, sodium, potassium, ammonium, and substituted ammonium salts such as mono-, di- and triiethanolamine salts) of the anionic sulfate, sulfonate, carboxylate and sarcosinate surfactants. Anionic sulfate and sulfonate surfactants are preferred. Preferred are surfactants systems comprising a sulfonate or a sulfate surfactant, preferably an alkyl sulfate, a linear or branched alkyl benzene sulfonate, or an alkyldiphenyloxide disulfonate, as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated C12-C18 monoesters) diesters of sulfosuccinate (especially saturated and unsaturated C6-C14 diesters), N-acyl sarcosinates. Resin acids and hydrogenated resin acids are also suitable, such as rosin, hydrogenated rosin, and resin acids and hydrogenated resin acids present in or derived from tallow oil. Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the C5-C17acyl-N—(C1-C4 alkyl) and —N—(C1-C2 hydroxyalkyl) glucamine sulfates, and sulfates of alkylpolysacchanides such as the sulfates of alkylpolyglucoside (the nonionic nonsulfated compounds being described herein). Alkyl sulfate surfactants are preferably selected from the linear and branched primary C10-C18 alkyl sulfates, more preferably the C11-C15 branched chain alkyl sulfates and the C12-C14 linear chain alkyl sulfates.

Alkyl ethoxysulfate surfactants are preferably selected from the group consisting of the C10-C18 alkyl sulfates which have been ethoxylated with from 0.5 to 20 moles of ethylene oxide per molecule. More preferably, the alkyl ethoxysulfate surfactant is a C11-C18, most preferably C11-C15 alkyl sulfate which has been ethoxylated with from 0.5 to 7, preferably from 1 to 5, moles of ethylene oxide per molecule. A particularly preferred aspect of the invention employs mixtures of the preferred alkyl sulfate and/or sulfonate and alkyl ethoxysulfate surfactants. Such mixtures have been disclosed in PCT Patent Application No. WO 93/18124.

Anionic sulfonate surfactants suitable for use herein include the salts of C5-C20 linear alkylbenzene sulfonates, alkyl ester sulfonates, C6-C22 primary or secondary alkane sulfonates, C6-C24 olefin sulfonates, sulfonated polycarboxylic acids, alkyl glycerol sulfonates, fatty acyl glycerol sulfonates, fatty oleyl glycerol sulfonates, and any mixtures thereof. Suitable anionic carboxylate surfactants include the alkyl ethoxy carboxylates, the alkyl polyethoxy polycarboxylate surfactants and the soaps ('alkyl carboxyls'), especially certain secondary soaps as described herein. Suitable alkyl ethoxy carboxylates include those with the formula RO(CH2CH20)x CH2C00$^-$M$^+$ wherein R is a C6 to C18 alkyl group, x ranges from 0 to 10, and the ethoxylate distribution is such that, on a weight basis, and M is a cation. Suitable alkyl polyethoxypolycarboxylate surfactants include those having the formula RO—(CHR$^1$—CHR$^2$-0)-R$^3$ wherein R is a C6 to C18 alkyl group, x is from 1 to 25, R$^1$ and R$^2$ are selected from the group consisting of hydrogen, methyl acid radical, succinic acid radical, hydroxysuccinic acid radical, and mixtures thereof, and R$^3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Other suitable anionic surfactants are the alkali metal sarcosinates of formula R—CON(R$^1$) CH—)COOM, wherein R is a C5-C17 linear or branched alkyl or alkenyl group, R$^1$ is a C1-C4 alkyl group and M is an alkali metal ion. Preferred examples are the myristyl and oleoyl methyl sarcosinates in the form of their sodium salts.

Essentially any alkoxylated nonionic surfactants are suitable herein. The ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Polyhydroxy fatty acid amides suitable for use herein are those having the structural formula R$^2$CONR$^1$Z wherein: R$^1$ is H, C1-C4 hydrocarbyl, 2-hydroxyethyl, 2-hydroxypropyl, ethoxy, propoxy, or a mixture thereof, preferable C1-C4 alkyl, more preferably C1 or C2 alkyl, most preferably C1 alkyl (i.e., methyl); and R$^2$ is a C5-C31 hydrocarbyl, preferably straight-chain C5-C19 alkyl or alkenyl, more preferably straight-chain C9-C17 alkyl or alkenyl, most preferably straight-chain C11-C17 alkyl or alkenyl, or mixture thereof, and Z is a polyhydroxyhydrocarbyl having a linear hydrocarbyl chain with at least 3 hydroxyls directly connected to the chain, or an alkoxylated derivative (preferably ethoxylated or propoxylated) thereof Z preferably will be derived from a reducing sugar in a reductive amination reaction; more preferably Z is a glycityl.

Suitable fatty acid amide surfactants include those having the formula: R$^1$CON(R$^2$)2 wherein R$^1$ is an alkyl group containing from 7 to 21, preferably from 9 to 17 carbon atoms and each R$^2$ is selected from the group consisting of hydrogen, C1-C4 alkyl, C1-C4 hydroxyalkyl, and —(C2H40)xH, where x is in the range of from 1 to 3.

Suitable alkylpolysaccharides for use herein are disclosed in U.S. Pat. No. 4,565,647 to Llenado, having a hydrophobic group containing from 6 to 30 carbon atoms and a polysaccharide, e.g., a polyglycoside, hydrophilic group containing from 1.3 to 10 saccharide units. Preferred alkylpolyglycosides have the formula: R$^2$O(CnH2nO)t(glycosyl)x wherein R$^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Suitable amphoteric surfactants for use herein include the amine oxide surfactants and the alkyl amphocarboxylic acids. Suitable amine oxides include those compounds having the formula R$^3$(OR$^4$)$_x$NO(R$^5$)$_2$ wherein R$^3$ is selected from an alkyl, hydroxyalkyl, acylamidopropyl and alkylphenyl group, or mixtures thereof, containing from 8 to 26 carbon atoms; R$^4$ is an alkylene or hydroxyalkylene group containing from 2 to 3 carbon atoms, or mixtures thereof, x is from 0 to 5, preferably from 0 to 3; and each R$^5$ is an alkyl or hydroxyalkyl group containing from 1 to 3, or a polyethylene oxide group containing from 1 to 3 ethylene oxide groups. Preferred are C10-C18 alkyl dimethylamine oxide, and C10-18 acylamido alkyl dimethylamine oxide. A suitable example of an alkyl amphodicarboxylic acid is Miranol™ C2M Conc. manufactured by Miranol, Inc., Dayton, N.J.

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphoniurn or tertiary sulfonium compounds. Betaine and sultaine surfactants are exemplary zwittenionic surfactants for use herein.

Suitable betaines are those compounds having the formula R(R$^1$)$_2$N$^+$R$^2$COO$^-$ wherein R is a C6-C18 hydrocarbyl. group, each R$^1$ is typically C1-C3 alkyl, and R$^2$ is a C1-C5 hydrocarbyl group. Preferred betaines are C12-18 dimethylammonio hexanoate and the C10-18 acylamidopropane (or ethane) dimethyl (or diethyl) betaines. Complex betaine surfactants are also suitable for use herein.

Suitable cationic surfactants to be used herein include the quaternary ammonium surfactants. Preferably the quaternary ammonium surfactant is a mono C6-C16, preferably C6-C10 N-alkyl or alkenyl ammonium surfactants wherein the remaining N positions are substituted by methyl, hydroxyethyl or hydroxypropyl groups. Preferred are also the monoalkoxylated and bis-alkoxylated amine surfactants.

Another suitable group of cationic surfactants which can be used in the detergent compositions or components thereof herein are cationic ester surfactants. The cationic ester surfactant is a, preferably water dispersible, compound having surfactant properties comprising at least one ester (i.e. —COO—) linkage and at least one cationically charged group. Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting, of carbon, nitrogen and oxygen atoms and any mixtures thereof, with the proviso that any nitrogen or oxygen atom in said chain connects only with carbon atoms in the chain. Thus spacer groups having, for example, -0-0- (i.e. peroxide), —N—N—, and —N-0- linkages are excluded, whilst spacer groups having, for example —CH2-O—CH2- and —CH2-NH—CH2- linkages are included. In a preferred aspect the spacer group chain comprises only carbon atoms, most preferably the chain is a hydrocarbyl chain.

Highly preferred herein are cationic mono-alkoxylated amine surfactants preferably of the general formula: $R^1R^2R^3N^+ApR^4X^-$ wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8. Preferably the $ApR^4$ group in the formula has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are —CH2CH2-OH, —CH2CH2CH2-OH, —CH2CH(CH3)-OH and —CH(CH3)CH2-OH, with —CH2CH2-OH being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula $R^1(CH3)(CH3)N^+(CH2CH20)_{2\text{-}5}H\ X^-$ wherein $R^1$ is C10-C18 hydrocarbyl and mixtures thereof, especially C10-C14 alkyl, preferably C10 and C12 alkyl, and X is any convenient anion to provide charge balance, preferably chloride or bromide.

As noted, compounds of the foregoing type include those wherein the ethoxy (CH2CH2O) units (EO) are replaced by butoxy, isopropoxy [CH(CH3)CH2O] and [CH2CH(CH3)O] units (i-Pr) or n-propoxy units (Pr), or mixtures of EO and/or Pr and/or i-Pr units.

The cationic bis-alkoxylated amine surfactant preferably has the general formula: $R^1R^2N^+ApR^3A'qR^4X^-$ wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from C1-C4 alkoxy, especially ethoxy, (i.e., —CH2CH2O—), propoxy, butoxy and mixtures thereof, p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula $R^1CH3N^+(CH2CH20H)(CH2CH20H)\ X^-$ wherein $R^1$ is C10-C18 hydrocarbyl and mixtures thereof, preferably C10, C12, C14 alkyl and mixtures thereof $X^-$ is any convenient anion to provide charge balance, preferably chloride. With reference to the general cationic bis-alkoxylated amine structure noted above, since in a preferred compound $R^1$ is derived from (coconut) C12-C14 alkyl fraction fatty acids, $R^2$ is methyl and $ApR^3$ and $A'qR^4$ are each monoethoxy.

Other cationic bis-alkoxylated amine surfactants useful herein include compounds of the formula: $R^1R^2N^+$—$(CH2CH2O)_pH$—$(CH2CH2O)_qH\ X^-$ wherein $R^1$ is C10-C18 hydrocarbyl, preferably C10-C14 alkyl, independently p is 1 to about 3 and q is 1 to about 3, $R^2$ is C1-C3 alkyl, preferably methyl, and $X^-$ is an anion, especially chloride or bromide.

Other compounds of the foregoing type include those wherein the ethoxy (CH2CH2O) units (EO) are replaced by butoxy (Bu) isopropoxy [CH(CH3)CH2O] and [CH2CH(CH3)O] units (i-Pr) or n-propoxy units (Pr), or mixtures of EO and/or Pr and/or i-Pr units.

Additional Adjuncts

The treatment compositions optionally contain one or more of the following adjuncts: shine agents, polishes, stain and soil repellents, lubricants, odor control agents, perfumes, fragrances and fragrance release agents, bleaching agents, drying agents, and rinsing agents. Other adjuncts include, but are not limited to, acids, electrolytes, dyes and/or colorants, solubilizing materials, stabilizers, thickeners, defoamers, hydrotropes, cloud point modifiers, preservatives, and other polymers. Other adjuncts include, but are not limited to, UV absorbers such as benzotriazoles, benzophenones, and the like; polymeric UV absorbers having a UV chromophore attached to a polymer backbone, solvents such as mineral oil and butyl cellosolve, and abrasive polishing agents such as silicas, zeolites, and the like. The acids, when used, include, but are not limited to, organic hydroxy acids, citric acids, keto acid, and the like. Electrolytes, when used, include, calcium, sodium and potassium chloride. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, and/or sources of hydrogen peroxide.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantogard and/or Glydant), hydantoins and carbamates, such as 1,3-Dihydroxymethyl-5,5-Dimethylhydantoin with 3-iodo-2-propynyl butyl carbamate available as Dantogard Plus from Lonza, Fairlawn, N.J., 1-(3-chloroallyl)-3,5,7-triaza-1-azoniaadamantane chloride as Dowicil 75 from Dow Chemical, Midland, Mich., and/or short chain alcohols (e.g. ethanol and/or IPA). The mildewstat or bacteriostat includes, but is not limited to, mildewstats (including non-isothiazolone compounds) include Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1, 3 diol, from Boots Company Ltd., PROXEL CRL, a propyl-p-hydroxybenzoate, from ICI PLC; NIPASOL M, an o-phenylphenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G.

These additional adjuncts are preferably present at a level of from 0.001% to 15% of the mitt or glove weight, preferably from 0.01% to 8% of the mitt weight, and more preferably from 0.1% to 6% of the mitt or glove weight.

Antimicrobial Agent

The treatment compositions of the invention may comprise traditional antimicrobial agents for substantial microbial control, including quaternary ammonium compounds or phenolics. Non-limiting examples of these quaternary compounds include benzalkonium chlorides and/or substituted benzalkonium chlorides, di($C_6$-$C_{14}$)alkyl di-short chain ($C_{1-4}$ alkyl and/or hydroxyalkl) quaternaryammonium salts, N-(3-chloroallyl) hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethylbenzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are also in this class. The antimicrobial agents are preferably present at a level of from 0.01% to 5% of the mitt or glove weight, preferably from 0.01% to 1% of the mitt weight, and more preferably from 0.01% to 0.5% of the mitt or glove weight.

Builder/Buffer

The treatment composition may include a builder or buffer, which increases the effectiveness of the surfactant. The builder or buffer can also function as a softener and/or a sequestering agent in the cleaning composition. A variety of builders or buffers can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives.

Builders or buffers can also include polyacetates and polycarboxylates. The polyacetate and polycarboxylate compounds include, but are not limited to, sodium, potassium, lithium, ammonium, and substituted ammonium salts of ethylenediamine tetraacetic acid (EDTA), ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builders or buffers can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2-methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are tri (hydroxymethyl) amino methane (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris(hydroxymethyl)methyl glycine (tricine). Other suitable buffers include ammonium carbamate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see WO 95/07971, which is incorporated herein by reference. Other preferred pH adjusting agents include sodium or potassium hydroxide.

When employed, the builder, buffer, or pH adjusting agent comprises at least about 0.001% and typically about 0.01-10% of the cleaning composition. Preferably, the builder or buffer content is about 0.1-2%.

Essential Oils

Compositions according to the invention may comprise pine oil, terpene derivatives and/or essential oils. Pine oil, terpene derivatives and essential oils are used primarily for cleaning efficacy. They may also provide some antimicrobial efficacy and deodorizing properties. Pine oil, terpene derivatives and essential oils may be present in the compositions in amounts of up to about 5% by weight, preferably in amounts of 0.1% to 1% by weight.

Pine oil is a complex blend of oils, alcohols, acids, esters, aldehydes and other organic compounds. These include terpenes which include a large number of related alcohols or ketones. Some important constituents include terpineol. One type of pine oil, synthetic pine oil, will generally contain a higher content of turpentine alcohols than the two other grades of pine oil, namely steam distilled and sulfate pine oils. Other important compounds include alpha- and beta-pinene (turpentine), abietic acid (rosin), and other isoprene derivatives. Particularly effective pine oils are commercially available from Mellennium Chemicals, under the Glidco tradename. These pine oils vary in the amount of terpene alcohols and alpha-terpineol.

Terpene derivatives appropriate for use in the inventive composition include terpene hydrocarbons having a functional group, such as terpene alcohols, terpene ethers, terpene esters, terpene aldehydes and terpene ketones. Examples of suitable terpene alcohols include verbenol, transpinocarveol, cis-2-pinanol, nopol, isoborneol, carbeol, piperitol, thymol, alpha-terpineol, terpinen-4-ol, menthol, 1,8-terpin, dihydroterpineol, nerol, geraniol, linalool, citronellol, hydroxycitronellol, 3,7-dimethyl octanol, dihydro-myrcenol, tetrahydro-alloocimenol, perillalcohol, and falcarindiol. Examples of suitable terpene ether and terpene ester solvents include 1,8-cineole, 1,4-cineole, isobornyl methylether, rose pyran, menthofuran, trans-anethole, methyl chavicol, allocimene diepoxide, limonene mono-epoxide, isobornyl acetate, nonyl acetate, terpinyl acetate, linalyl acetate, geranyl acetate, citronellyl acetate, dihydro-terpinyl acetate and meryl acetate. Further, examples of suitable terpene aldehyde and terpene ketone solvents include myrtenal, campholenic aldehyde, perillaldehyde, citronellal, citral, hydroxy citronellal, camphor, verbenone, carvenone, dihydro-carvone, carvone, piperitone, menthone, geranyl acetone, pseudo-ionone, ionine, iso-pseudo-methyl ionone, n-pseudo-methyl ionone, iso-methyl ionone and n-methyl ionone.

Essential oils include, but are not limited to, those obtained from thyme, lemongrass, citrus, lemons, oranges, anise, clove, aniseed, pine, cinnamon, geranium, roses, mint, lavender, citronella, eucalyptus, peppermint, camphor, sandalwood, rosmarin, vervain, fleagrass, lemongrass, ratanhiae, cedar and mixtures thereof. Preferred essential oils to be used herein are thyme oil, clove oil, cinnamon oil, geranium oil, eucalyptus oil, peppermint oil, mint oil or mixtures thereof.

Actives of essential oils to be used herein include, but are not limited to, thymol (present for example in thyme), eugenol (present for example in cinnamon and clove), menthol (present for example in mint), geraniol (present for example in geranium and rose), verbenone (present for example in vervain), eucalyptol and pinocarvone (present in eucalyptus), cedrol (present for example in cedar), anethol (present for example in anise), carvacrol, hinokitiol, berberine, ferulic acid, cinnamic acid, methyl salycilic acid, methyl salycilate, terpineol and mixtures thereof. Preferred actives of essential oils to be used herein are thymol, eugenol, verbenone, eucalyptol, terpineol, cinnamic acid, methyl salycilic acid, citric acid and/or geraniol.

Other essential oils include Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69.degree. C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methhyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen. Each of these botanical oils is commercially available.

Particularly preferred oils include peppermint oil, lavender oil, bergamot oil (Italian), rosemary oil (Tunisian), and sweet orange oil. These may be commercially obtained from a variety of suppliers including: Givadan Roure Corp. (Clifton, N.J.); Berje Inc. (Bloomfield, N.J.); BBA Aroma Chemical Div. of Union Camp Corp. (Wayne, N.J.); Firmenich Inc. (Plainsboro N.J.); Quest International Fragrances Inc. (Mt. Olive Township, N.J.); Robertet Fragrances Inc. (Oakland, N.J.). Particularly useful lemon oil and d-limonene compositions which are useful in the invention include mixtures of terpene hydrocarbons obtained from the essence of oranges, e.g., cold-pressed orange terpenes and orange terpene oil phase ex fruit juice, and the mixture of terpene hydrocarbons expressed from lemons and grapefruit.

Hydrophilic Water Soluble or Water Dispersible Polymers

In preferred embodiments of the invention, a hydrophilic water soluble or water dispersible polymer is incorporated into the present compositions. The polymer preferably improves the hydrophilicity of the surface being treated. The increase in hydrophilicity provides improved final appearance by providing "sheeting" of the water from the surface and/or spreading of the water on the surface, and this effect is preferably seen when the surface is rewetted and even when subsequently dried after the rewetting. Polymer substantivity is beneficial as it prolongs the sheeting and cleaning benefits. Another important feature of preferred polymers is lack of visible residue upon drying. In preferred embodiments, the polymer comprises 0.01 to 5%, preferably 0.01 to 1%, and most preferably 0.1 to 0.5% of the cleaning composition.

In general, the aqueous polymer containing composition may comprise a water soluble or water dispersible polymer. The hydrophilic polymers preferably are attracted to surfaces and are absorbed thereto without covalent bonds. Examples of suitable polymers include the polymers and co-polymers of N,N dimethyl acrylamide, acrylamide, and certain monomers containing quaternary ammonium groups or amphoteric groups that favor substantivity to surfaces, along with co-monomers that favor adsorption of water, such as, for example, acrylic acid and other acrylate salts, sulfonates, betaines, and ethylene oxides.

With respect to the synthesis of the water soluble or water dispersible cationic copolymer, the level of the first monomer, which has a permanent cationic charge or that is capable of forming a cationic charge on protonation, is typically between 3 and 80 mol % and preferably 10 to 60 mol % of the copolymer. The level of second monomer, which is an acidic monomer that is capable of forming an anionic charge in the composition, when present is typically between 3 and 80 mol % and preferably 10 to 60 mol % of the copolymer. The level of the third monomer, which has an uncharged hydrophilic group, when present is typically between 3 and 80 mol % and preferably 10 to 60 mol % of the copolymer. When present, the level of uncharged hydrophobic monomer is less than about 50 mol % and preferably less than 10 mol % of the copolymer. The molar ratio of the first monomer to the second monomer typically ranges from 19:1 to 1:10 and preferably ranges from 9:1 to 1:6. The molar ratio of the first monomer to the third monomer is typically ranges from 4:1 to 1:4 and preferably ranges from 2:1 to 1:2.

The average molecular weight of the copolymer typically ranges from about 5,000 to about 10,000,000, with the preferred molecular weight range depending on the polymer composition with the proviso that the molecular weight is selected so that the copolymer is water soluble or water disperible to at least 0.01% by weight in distilled water at 25° C.

Examples of permanently cationic monomers include, but are not limited to, quaternary ammonium salts of substituted acrylamide, methacrylamide, acrylate and methacrylate, such as trimethylammoniumethylmethacrylate, trimethylammoniumpropylmethacrylamide, trimethylammoniumethylmethacrylate, trimethylammoniumpropylacrylamide, 2-vinyl N-alkyl quaternary pyridinium, 4-vinyl N-alkyl quaternary pyridinium, 4-vinylbenzyltrialkylammonium, 2-vinyl piperidinium, 4-vinyl piperidinium, 3-alkyl 1-vinyl imidazolium, diallyldimethylammonium, and the ionene class of internal cationic monomers as described by D. R. Berger in *Cationic Surfactants, Organic Chemistry*, edited by J. M. Richmond, Marcel Dekker, New York, 1990, ISBN 0-8247-8381-6, which is incorporated herein by reference. This class includes co-poly ethylene imine, co-poly ethoxylated ethylene imine and co-poly quaternized ethoxylated ethylene imine, co-poly [(dimethylimino) trimethylene (dimethylimino) hexamethylene disalt], co-poly [(diethylimino) trimethylene (dimethylimino) trimethylene disalt], co-poly [(dimethylimino) 2-hydroxypropyl salt], co-polyquarternium-2, co-polyquarternium-17, and co-polyquarternium-18, as described in the *International Cosmetic Ingredient Dictionary,* 5th Edition, edited by J. A. Wenninger and G. N. McEwen, which is incorporated herein by reference. Other cationic monomers include those containing cationic sulfonium salts such as co-poly-1-[3-methyl-4-(vinyl-benzyloxy) phenyl] tetrahydrothiophenium chloride. Especially preferred monomers are mono- and di-quaternary derivatives of methacrylamide. The counterion of the cationic co-monomer can be selected from, for example, chloride, bromide, iodide, hydroxide, phosphate, sulfate, hydrosulfate, ethyl sulfate, methyl sulfate, formate, and acetate.

Examples of monomers that are cationic on protonation include, but are not limited to, acrylamide, N,N-dimethylacrylamide, N,N di-isopropylacryalmide, N-vinylimidazole, N-vinylpyrrolidone, ethyleneimine, dimethylaminohydroxypropyl diethylenetriamine, dimethylaminoethylmethacrylate, dimethylaminopropylmethacrylamide, dimethylaminoethylacrylate, dimethylaminopropylacrylamide, 2-vinyl pyridine, 4-vinyl pyridine, 2-vinyl piperidine, 4-vinylpiperidine, vinyl amine, diallylamine, methyldiallylamine, vinyl oxazolidone; vinyl methyoxazolidone, and vinyl caprolactam.

Monomers that are cationic on protonation typically contain a positive charge over a portion of the pH range of 2-11. Such suitable monomers are also presented in *Water-Soluble Synthetic Polymers Properties and Behavior*, Volume II, by P. Molyneux, CRC Press, Boca Raton, 1983, ISBN 0-8493-6136. Additional monomers can be found in the *International Cosmetic Ingredient Dictionary,* 5th Edition, edited by J. A. Wenninger and G. N. McEwen, The Cosmetic, Toiletry, and Fragrance Association, Washington D.C., 1993, ISBN 1-882621-06-9. A third source of such monomers can be found in *Encyclopedia of Polymers and Thickeners for Cosmetics*, by R. Y. Lochhead and W. R. Fron, Cosmetics & Toiletries, vol. 108, May 1993, pp 95-135. All three references are incorporated herein.

Examples of acidic monomers that are capable of forming an anionic charge in the composition include, but are not limited to, acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, citraconic acid, vinylbenzoic acid, N-vinylsuccinamidic acid, mesaconic acid, methacroylalanine, acryloylhydroxyglycine, sulfoethyl methacrylate, sulfopropyl acrylate, and sulfoethyl acrylate. Preferred acid monomers also include styrenesulfonic acid, 2-methacryloyloxymethane-1-sulfonic acid, 3-methacryloyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid and vinyl phosphoric acid. Most preferred monomers include acrylic acid, methacrylic acid and maleic acid. The copolymers useful in this invention may contain the above acidic monomers and the alkali metal, alkaline earth metal, and ammonium salts thereof.

Examples of monomers having an uncharged hydrophilic group include but are not limited to vinyl alcohol, vinyl acetate, vinyl methyl ether, vinyl ethyl ether, ethylene oxide and propylene oxide. Especially preferred are hydrophilic esters of monomers, such as hydroxyalkyl acrylate esters, alcohol ethoxylate esters, alkylpolyglycoside esters, and polyethylene glycol esters of acrylic and methacrylic acid.

Finally, examples of uncharged hydrophobic monomers include, but are not limited to, C1-C4 alkyl esters of acrylic acid and of methacrylic acid.

The copolymers are formed by copolymerizing the desired monomers. Conventional polymerization techniques can be employed. Illustrative techniques include, for example, solution, suspension, dispersion, or emulsion polymerization. A preferred method of preparation is by precipitation or inverse suspension polymerization of the copolymer from a polymerization media in which the monomers are dispersed in a suitable solvent. The monomers employed in preparing the copolymer are preferably water soluble and sufficiently soluble in the polymerization media to form a homogeneous solution. They readily undergo polymerization to form polymers which are water-dispersable or water-soluble. The preferred copolymers contain acrylamide, methacrylamide and substituted acrylamides and methacrylamides, acrylic and methacrylic acid and esters thereof. Suitable synthetic methods for these copolymers are described, for example, in Kirk-Othmer, *Encyclopedia of Chemical Technology*, Volume 1, Fourth Ed., John Wiley & Sons.

Other examples of polymers that provide the sheeting and anti-spotting benefits are polymers that contain amine oxide hydrophilic groups. Polymers that contain other hydrophilic groups such a sulfonate, pyrrolidone, and/or carboxylate groups can also be used. Examples of desirable poly-sulfonate polymers include polyvinylsulfonate, and more preferably polystyrene sulfonate, such as those sold by Monomer-Polymer Dajac (1675 Bustleton Pike, Feasterville, Pa. 19053). A typical formula is as follows.

$$[CH(C_6H_4SO_3Na)—CH_2]_n—CH(C_6H_5)—CH_2$$

wherein n is a number to give the appropriate molecular weight as disclosed below.

Typical molecular weights are from about 10,000 to about 1,000,000, preferably from about 200,000 to about 700,000. Preferred polymers containing pyrrolidone functionalities include polyvinyl pyrrolidone, quaternized pyrrolidone derivatives (such as Gafquat 755N from International Specialty Products), and co-polymers containing pyrrolidone, such as polyvinylpyrrolidone/dimethylaminoethylmethacrylate (available from ISP) and polyvinyl pyrrolidone/acrylate (available from BASF). Other materials can also provide substantivity and hydrophilicity including cationic materials that also contain hydrophilic groups and polymers that contain multiple ether linkages. Cationic materials include cationic sugar and/or starch derivatives and the typical block copolymer detergent surfactants based on mixtures of polypropylene oxide and ethylene oxide are representative of the polyether materials.

Preferred polymers comprise water-soluble amine oxide moieties. It is believed that the partial positive charge of the amine oxide group can act to adhere the polymer to the surface of the surface substrate, thus allowing water to "sheet" more readily. To the extent that polymer anchoring promotes better "sheeting" higher molecular materials are preferred. Increased molecular weight improves efficiency and effectiveness of the amine oxide-based polymer. The preferred polymers of this invention have one or more monomeric units containing at least one N-oxide group. At least about 10%, preferably more than about 50%, more preferably greater than about 90% of said monomers forming said polymers contain an amine oxide group. These polymers can be described by the general formula:

$$P(B)$$

wherein each P is selected from homopolymerizable and copolymerizable moieties which attach to form the polymer backbone, preferably vinyl moieties, e.g. C(R)2-C(R)2, wherein each R is H, C1-C12 (preferably C.sub.1-C.sub.4) alkyl(ene), C6-C12 aryl(ene) and/or B; B is a moiety selected from substituted and unsubstituted, linear and cyclic C1-C12 alkyl, C1-C12 alkylene, C1-C12 heterocyclic, aromatic C6-C12 groups and wherein at least one of said B moieties has at least one amine oxide group present; u is from a number that will provide at least about 10% monomers containing an amine oxide group to about 90%; and t is a number such that the average molecular weight of the polymer is from about 2,000 to about 500,000, preferably from about 5,000 to about 250,000, and more preferably from about 7,500 to about 200,000. Preferred polymers also include poly(4-vinylpyridine N-oxide) polymers (PVNO), wherein the average molecular weight of the polymer is from about 2,000 to about 500,000 preferably from about 5,000 to about 400,000, and more preferably from about 7,500 to about 300,000. In general, higher molecular weight polymers are preferred. Often, higher molecular weight polymers allow for use of lower levels of the wetting polymer, which can provide benefits in floor cleaner applications. The desirable molecular weight range of polymers useful in the present invention stands in contrast to that found in the art relating to polycarboxylate, polystyrene sulfonate, and polyether based additives which prefer molecular weights in the range of 400,000 to 1,500,000. Lower molecular weights for the preferred poly-amine oxide polymers of the present invention are due to greater difficulty in manufacturing these polymers in higher molecular weight.

Some non-limiting examples of homopolymers and copolymers which can be used as water soluble polymers of the present invention are: adipic acid/dimethylaminohydroxypropyl diethylenetriamine copolymer; adipic acid/epoxypropyl diethylenetriamine copolymer; polyvinyl alcohol; methacryloyl ethyl betaine/methacrylates copolymer; ethyl acrylate/methyl methacrylate/methacrylic acid/acrylic acid copolymer; polyamine resins; and polyquaternary amine resins; poly(ethenylformamide); poly(vinylamine) hydrochloride; poly(vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride). Preferably, said copolymer and/or homopolymers are selected from the group consisting of adipic acid/dimethylaminohydroxypropyl diethylenetriamine copolymer; poly(vinylpyrrolidone/dimethylaminoethyl methacrylate); polyvinyl alcohol; ethyl acrylate/methyl methacrylate/ethacrylic acid/acrylic acid copolymer; methacryloyl ethyl betaine/methacrylates copolymer; polyquaternary amine resins; poly(ethenylformamide); poly(vinylamine) hydrochloride; poly(vinyl alcohol-co-6% vinylamine); poly(vinyl alcohol-co-12% vinylamine); poly (vinyl alcohol-co-6% vinylamine hydrochloride); and poly (vinyl alcohol-co-12% vinylamine hydrochloride).

Polymers useful in the present invention can be selected from the group consisting of copolymers of hydrophilic monomers. The polymer can be linear random or block copolymers, and mixtures thereof. The term "hydrophilic" is used herein consistent with its standard meaning of having affinity for water. As used herein in relation to monomer units and polymeric materials, including the copolymers, "hydrophilic" means substantially water-soluble. In this regard, "substantially water soluble" shall refer to a material that is soluble in distilled (or equivalent) water, at 25° C., at a concentration of about 0.2% by weight, and are preferably soluble at about 1% by weight. The terms "soluble", "solubility" and the like, for purposes hereof, correspond to the maximum concentration of monomer or polymer, as applicable, that can dissolve in water or other solvents to form a homogeneous solution, as is well understood to those skilled in the art.

Nonlimiting examples of useful hydrophilic monomers are unsaturated organic mono- and polycarboxylic acids, such as acrylic acid, methacrylic acid, crotonic acid, malieic acid and its half esters, itaconic acid; unsaturated alcohols, such as vinyl alcohol, allyl alcohol; polar vinyl heterocyclics, such as, vinyl caprolactam, vinyl pyridine, vinyl imidazole; vinyl amine; vinyl sulfonate; unsaturated amides, such as acrylamides, e.g., N,N-dimethylacrylamide, N-t-butyl acrylamide; hydroxyethyl methacrylate; dimethylaminoethyl methacrylate; salts of acids and amines listed above; and the like; and mixtures thereof. Some preferred hydrophilic monomers are acrylic acid, methacrylic acid, N,N-dimethyl acrylamide, N,N-dimethyl methacrylamide, N-t-butyl acrylamide, dimethylamino ethyl methacrylate, thereof, and mixtures thereof. Polycarboxylate polymers are those formed by polymerization of monomers, at least some of which contain carboxylic functionality. Common monomers include acrylic acid, maleic acid, ethylene, vinyl pyrrolidone, methacrylic acid, methacryloylethylbetaine, etc. Preferred polymers for substantivity are those having higher molecular weights. For example, polyacrylic acid having molecular weights below about 10,000 are not particularly substantive and therefore do not normally provide hydrophilicity for three rewettings with all compositions, although with higher levels and/or certain surfactants like amphoteric and/or zwitterionic detergent surfactants, molecular weights down to about 1000 can provide some results. In general, the polymers should have molecular weights of more than about 10,000, preferably more than about 20,000, more preferably more than about 300,000, and even more preferably more than about 400,000. It has also been found that higher molecular weight polymers, e.g., those having molecular weights of more than about 3,000,000, are extremely difficult to formulate and are less effective in providing anti-spotting benefits than lower molecular weight polymers. Accordingly, the molecular weight should normally be, especially for polyacrylates, from about 20,000 to about 3,000,000; preferably from about 20,000 to about 2,500,000; more preferably from about 300,000 to about 2,000,000; and even more preferably from about 400,000 to about 1,500,000.

An advantage for some polycarboxylate polymers is the detergent builder effectiveness of such polymers. Although such polymers do hurt filming/streaking, like other detergent builders, they provide increased cleaning effectiveness on typical, common "hard-to-remove" soils that contain particulate matter.

Some polymers, especially polycarboxylate polymers, thicken the compositions that are aqueous liquids. This can be desirable. Typically, the viscosity under shear should be less than about 200 cp, preferably less than about 100 cp, more preferably less than about 50 cp.

Non limiting examples of polymers for use in the present invention include the following: poly(vinyl pyrrolidone/acrylic acid) sold under the name "Acrylidone"® by ISP and poly(acrylic acid) sold under the name "Accumer"® by Rohm & Haas. Other suitable materials include sulfonated polystyrene polymers sold under the name Versaflex® sold by National Starch and Chemical Company, especially Versaflex 7000. The level of polymeric material will normally be less than about 0.5%, preferably from about 0.001% to about 0.4%, more preferably from about 0.01% to about 0.3%. In general, lower molecular weight materials such as lower molecular weight poly(acrylic acid), e.g., those having molecular weights below about 10,000, and especially about 2,000, do not provide good anti-spotting benefits upon rewetting, especially at the lower levels, e.g., about 0.02%. One should use only the more effective materials at the lower levels. In order to use lower molecular weight materials, substantivity should be increased, e.g., by adding groups that provide improved attachment to the surface, such as cationic groups, or the materials should be used at higher levels, e.g., more than about 0.05.

Silicones

The treatment composition optionally contains a silicone, i.e. dimethylpolysiloxane, or derivative thereof. One derivative is an amino-functional silicone fluids, which can be prepared, for example, as described in U.S. Pat. Application US20030053975 to Eissmann et al. Useful silicones and silicone derivatives are also described in U.S. Pat. No. 6,506,715 to Schultz and Healy; U.S. Pat. No. 6,013,323 to Klayder and Lupyan; U.S. Pat. No. 5,639,557 to Okamura and Shinohara; and U.S. Pat. Application US20020120057 to Gosselink et al. A wide variety of silicones are available commercially. Typically, these silicones are composed substantially of dimethylpolysiloxane, although substituted dimethylpolysiloxane substituted with various other ingredients are also known. In accordance with the invention, any conventional dimethylpolysiloxane or substituted dimethylpolysiloxane can be used. In a preferred embodiment, the silicones are linear and cyclic siloxanes, including octamethyl cyclotetrasiloxane, decamethyl cyclopentasiloxane, and dodecamethyl cyclohexasiloxane. In a preferred embodiment, the silicones are DC 245, DC 246, or DC OS-30, available from Dow Chemical, Midland, Mich.

The silicone may exist in a single phase or as an emulsion of one or more derivatized or underivatized silicone compounds such as dimethyl-containing silicone fluids, amino-functional silicone fluids, and silicone resins. Preferably, the emulsified silicone is a mixture of dimethyl silicone fluid, amino-functional silicone fluid, and silicone resin. The dimethyl silicone, for example, "WS101", the amino-functional silicone, for example "F784" or "F785", and the silicone resin, for example "VP1038", may be obtained from Wacker, Inc.

In accordance with the present invention, silicones having viscosities on the order of 10 to 100,000, preferably 20 to 70,000, more preferably 200 to 10,000 centipoise can be employed. Also, the amount of silicone liquid included can vary widely. Silicones may be present in the treatment composition in concentrations of 0.5 to 15 wt. %, more preferably 1 to 10 wt. %.

Waxes

The treatment composition optionally contains a wax. Waxes suitable for use in the present invention include vegetable waxes such as carnauba, candelilla, and ouricury; mineral waxes such as montan, paraffin, and microcrystalline waxes; animal waxes, such as, beeswax; and synthetic waxes such as amide waxes and silicone waxes. Useful waxes, derivatives, and emulsion formulations are also described in U.S. Pat. No. 6,506,715 to Schultz and Healy; and U.S. Pat. Application US20010025021 to Wittkowski et al. Other useful waxes include micronized waxes. Specific examples of commercially available micronized waxes useful in the present invention are the series of micronized waxes sold under the mark CERIDUST® by Hoechst Celanese Corporation of Somerville, N.J. and the series of micronized waxes sold under the designation AQUA WAXES™, AQUA BEAD WAX™, and MICROSPERSION WAXES sold by Micropowders, Inc., of Terrytown, N.Y.

In a preferred embodiment of the invention, mixtures of two or more different types of waxes are employed. For example, mixtures of low molecular weight polyethylene waxes and paraffin waxes are particularly suitable for use in the present invention. In a particularly preferred embodiment of the invention, a mixture of a CERIDUST™ brand wax sold by Hoechst Celanese Corporation, particularly CERIDUST™ 9630 F and an AQUA BEAD wax sold by Micropowders, Inc., particularly AQUA BEAD 916, is used.

In still another preferred embodiment of the invention, other micronized polymers can be used in addition to the wax component. In this regard, it is already known that micronized polytetrafluoroethylene (PTFE) can be used in combination with micronized waxes to achieve higher surface lubricity and anti-blocking properties in other environments. Micronized polytetrafluoroethylene can also be included in the finish-treating compositions of the present invention to increase lubricity and water repellency thereof. Other micronized polymers such as polyamide and the like can also be used.

Waxes may be present in the treatment composition in concentrations of 0.1 to 15 wt. %, more preferably 1 to 10 wt. %.

Bleach

The treatment composition optionally contains a bleach. Bleaching agents according to the present invention may include both chlorine and oxygen bleaching systems, as described in U.S. Pat. No. 6,462,007 to Pieroni et al. Such agents are well known in the art, and include for example sodium dichloroisocyanurate or sodium hypochlorite. The composition preferably comprises a peroxide source, bleach activator, or combination thereof, as described in U.S. Pat. No. 6,551,983 to Welch et al.

Abrasive

The treatment composition optionally contains an abrasive such as a perlite, silica sand, zeolite, and various other insoluble, inorganic particulate abrasives are also possible, such as quartz, pumice, feldspar, tripoli and calcium phosphate. The abrasive is preferably calcium carbonate. The treatment composition may also contain softer abrasives such as clays and titanium dioxide. The abrasive can be present in amounts ranging from about 0.1% to 70% by weight of the treatment composition.

Water

When the inventive treatment composition is a solid or paste, water will not be, along with the solvent, a predominant ingredient. The water is preferably present at a level of less than 50%, more preferably less than about 10%, and most preferably, less than about 5%.

Instructions for Use

The present invention encompasses instructions for applying the mitt or glove to a hard surface. In another embodiment, the invention encompasses instructions for applying the mitt or glove to a hard surface followed by rinsing. In another embodiment, the invention encompasses instructions for applying the mitt or glove to a wet, hard surface followed by rinsing. In another embodiment, the invention encompasses instructions for getting the mitt or glove wet and for applying the mitt or glove to a hard surface. In another embodiment, the invention encompasses instructions for getting the mitt or glove wet and for applying the mitt or glove to a wet, hard surface followed by rinsing.

In another embodiment, the invention encompasses a set of instructions for use on surfaces, selected from a group consisting of: kitchens, bathrooms, exterior house surfaces, floors, walls, tiles, windows, sinks, showers, shower curtains, wash basins, dishes, or combinations thereof. In another embodiment, the invention encompasses a set of instructions for use on car surfaces, selected from a group comprising: exterior body, interior windows, exterior windows, wheels, tires, interior surfaces or combinations thereof.

Kits

Preferred mitts or gloves can be packaged in a kit, said kit additionally comprising a mitt or glove or several mitts or gloves, usage instructions, or combinations thereof.

EXAMPLES

Examples of inventive treatment compositions on the disposable mitt or glove are shown in Table 1.

TABLE 1

| Components | Example A | Example B | Example C | Example D |
|---|---|---|---|---|
| Nacconol 90G[a] | 4% | | | |
| Ninol 40-CO[b] | | 2% | | |
| Stepanol ME-Dry[c] | | | 8% | |
| BTC 2565[d] | | 0.5% | | |
| Glucopon 650-EC[e] | | | | 10% |
| Calcium hypochlorite[f] | | | 1% | |
| DC200 Fluid[g] | | | | 1% |
| PVP K-90[h] | | 0.5% | | |
| UNILIN ® 425[i] | | | | 2% |
| Outer layer[j] | Yes | Yes | Yes | Yes |
| Single inner layer[k] | | Yes | Yes | |
| Inner layer and middle layer[l] | Yes | | | |

Weight percent actives based on total mitt or glove weight.
[a]Sodium alkylbenzenesulfonate, Stepan Company, Northfield, Illinois.
[b]Coco diethanolamide, Stepan Company, Northfield, Illinois.
[c]Sodium lauryl sulfate, Stepan Company, Northfield, Illinois.
[d]N-Alkyldimethylbenzyl ammonium chloride, Stepan Company, Northfield, Illinois.
[e]Cocoglucoside, Cognis Corporation, Cincinnati, Ohio.
[f]PPG Industries, Pittsburg, Pennsylvania.
[g]Silicone fluid, Dow Corning, Midland, Michigan.
[h]Polyvinylpyrrolidone, International Specialty Products, Wayne, New Jersey.
[i]Polyethylene 460 alcohol wax, Baker Petrolite Corp., Tulsa, Okla.
[j]Needle punched, 103000-60T, from Hollinee, Ingleside, Illinois.
[k]55% Wood Pulp/45% Pet, K969, Dupont, Old Hickory, TN.
[l]Spunbond PET extrusion coated onto a PE thin film, Clopay, Cincinnati, OH.

Comparison to Current Commercial Mitts

The inventive mitt or glove was found to have superior performance properties to currently existing commercial mitts or gloves. The following test methods were performed and the results tabulated in Tables 2 and 3. All of the products, which contained soap or surfactant were rinsed of all soap and surfactant and dried at 120° F. prior to testing.

Wicking Test

Fill a 500 ml beaker with water to a 2.5" height (approximately half-full). Add 1 drop of blue dye to beaker and mix. Suspend 3"×3" non-woven piece above beaker (binder clip on bar). Lower bar until bottom ¼" of nonwoven is submerged. Leave for 3 minutes. After elapsed time, raise bar and measure from the bottom of the nonwoven to the top of the blue dye. The measurement is the wicking height. The preferred wicking height is less than 1".

Foam Height Test

Fill a 50 ml graduated cylinder with 2.44 g of 15% sodium linear alkylbenzene sulfate solution. Lower 2"×2" nonwoven piece into bottom of graduated cylinder and plunge up and down for 1 min with a non-absorbent plunger-type instrument (e.g. handle of a Teflon coated glassware brush). While plunger and nonwoven remain in bottom of graduated cylinder, measure the height of the foam at the meniscus with a ruler. Measure the foam immediately since it disappears quickly. Subtract the height of the nonwoven itself in the bottom of the graduated cylinder. The difference is the foam height. If the sample absorbs all the liquid, then the foam height is 0.

Dry and Wet Resiliency Test

The nonwoven is cut into an area of 8 cm by 8 cm. The thickness is measured with a Thwing-Albert ProGage caliper. Place a 3500 g weight (12 cm by 12 cm tile plus added weight to equal 3500 g) on the nonwoven for 2 min. Remove the weight and allow the nonwoven to recover for 30 sec. Remeasure the thickness. The dry resiliency in percent is measured by (thickness before compression minus thickness after compression) divided by (thickness before compression) times 100.

The nonwoven is cut into an area of 8 cm by 8 cm. The thickness is measured with a Thwing-Albert ProGage caliper. The nonwoven is submerged in 50 g of water in a 250 ml beaker for 30 sec. The nonwoven is removed with a forceps and allowed to drip into the beaker for 30 sec. The weight of the water remaining in the beaker is recorded. The weight of the original water minus the weight of the water left in the beaker divided by 64 square cm gives the absorption per square cm. Place a 3500 g weight (12 cm by 12 cm tile plus added weight to equal 3500 g) on the nonwoven for 2 min. Remove the weight and allow the nonwoven to recover for 30 sec. Remeasure the thickness. The wet resiliency in percent is measured by (thickness before compression minus thickness after compression) divided by (thickness before compression) times 100.

Absorbency

Submerge a 8 cm×8 cm section of nonwoven into 50 g of water in a 250 g beaker for 30 seconds. Use forceps to remove nonwoven and allow it to drip into beaker for 30 seconds. Record amount of water left in beaker after dripping. The percent absorbency is measured by (original amount of water minus water remaining after layer immersion and removal) divided by (original amount of water) times 100).

TABLE 2

| Product | Basis Weight (GSM) | Foam Height (inches) | Wicking Height (inches) | Thickness (mm) |
|---|---|---|---|---|
| NicSand PowerWool Wash Mitts[a] | 289 | 0 | 1 | 11.7 |
| Greased Lightning WashMit ®[b] | 266 | 0.25 | 2 | 1.9 |
| Holts by WashMit ®[c] | 292 | 0 | 2 | 1.8 |
| Comparative Outer layer[d] | 258 | 0.5 | 2 | |
| Inventive outer layer[e] | 105 | 0.5 | 0.5 | 2.6 |

[a]NicSand Inc., Cleveland, Ohio. The NicSand product is comprised of PET fibers glued to a backing and, therefore, should not be considered a non-woven.
[b]A & M Cleaning Products, Inc., Clemson, South Carolina.
[c]Holt Lloyd International, Stockport, UK.
[d]Webril process, cotton, BBA Nonwovens, Nashville, Tennessee.
[e]Bico/WP, Airlaid/latex, Concert Industries, Vancouver, BC, Canada.

TABLE 3

| Product | Basis Weight (GSM = g/m$^2$) | Thickness (mm) | Dry Resiliency (%) | Wet Resiliency (%) | Absorbency (%) |
|---|---|---|---|---|---|
| NicSand PowerWool Wash Mitts | 289 | 11.7 | 7.9 | 13.5 | 13.5 |
| Greased Lightning WashMit ® | 266 | 1.9 | 2.1 | 1.1 | 2.9 |
| Holts by WashMit ® | 292 | 1.8 | 0 | 4.6 | 6.7 |
| Inventive outer layer[a] | 100 | 2.5 | 2.4 | 2.9 | 5.1 |
| Inventive outer layer[b] | 113 | 4.8 | 5.1 | 7.7 | 4.5 |
| Inventive outer layer[c] | 148 | 3.0 | 5.0 | 4.3 | 8.0 |
| Inventive outer layer[d] | 166 | 3.7 | 5.6 | 9.3 | 9.8 |

[a]OAG630, Needlepunch, Foss Manufacturing, Hampton, New Hampshire.
[b]TherBind, Needlepunch, Carlee Corp., Rockleigh, New Jersey.
[c]OAJ141, Needlepunch, Foss Manufacturing, Hampton, New Hampshire.
[d]104100-72T, Needlepunch, Hollinee, Ingleside, Illinois.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. A device for treating hard surfaces, comprising:

a. a substrate having a first outwardly facing side and a second outwardly facing side opposed to said first side, wherein said first and second sides are bonded together creating an outer seam and leaving an entry portion along one edge of each of said first and second sides;

i. wherein said substrate has at least two layers on at least one of said outwardly facing sides;

ii. wherein said substrate has at least one low density layer having a basis weight of less than 200 g per meter squared and a thickness greater than 2 mm; and b. wherein said substrate is impregnated with a treatment composition comprising: a cleaning composition on said first side and a separate waxing composition on said second side, wherein the waxing composition is primarily on the outside of said second side;

c. wherein said device contains one or more tack regions; and d. wherein said tack region or regions are internal, positioned between finger or thumb areas when the device is placed on a user's hand, and not reaching the outer seam or the entry portion of the device.

2. The device of claim 1, wherein said low density layer has a basis weight of less than 150 g per meter squared.

3. The device of claim 1, wherein said low density layer has a basis weight of less than 125 g per meter squared.

4. The device of claim 1, wherein said low density layer comprises fibers selected from the group consisting of PET, PP, cellulose, regenerated cellulose, bicomponent fibers or combinations thereof.

5. The device of claim 1, wherein said low density layer comprises fibers selected from the group consisting of PET, PP, or combinations thereof.

6. The device of claim 1, wherein said low density layer has a wicking height of less than 1 inch.

7. The device of claim 1, wherein said outer seam is ultrasonically bonded and said outer seam contains one or more anchor points, wherein said anchor points are near said entry portion and at their widest point said anchor points comprise approximately 35 percent or greater of the seam width.

8. The device of claim 1, wherein said entry portion is an ultrasonically bonded cuff area.

9. The device of claim 1, wherein said tack region or regions are two or more dots or points.

10. The device of claim 9, wherein said tack region or regions are triangular lines or triangularly spaced dots.

11. The device of claim 9, wherein said tack region is a single dot.

12. The device of claim 1, wherein said substrate has at least two layers on at least one of said outwardly facing sides and one of said layers is coated onto the other of said layers by a means selected from the group selected from extrusion coating, adhesive bonding, or combinations thereof.

13. The device of claim 12, wherein one of said layers comprises material selected from the group consisting of extrusion coated polyethylene, polypropylene, polyester, polyethylene terephthalate, a blend of one or more of these materials and cellulosic material, or combinations thereof.

14. The device of claim 1, wherein said substrate has at least two layers on at least one of said outwardly facing sides and one of said layers comprises material selected from the group consisting of cellulosic material, polyethylene, polypropylene, polyester, polyethylene terephthalate, a blend of one or more of these materials or combinations thereof.

15. The device of claim 14, wherein one of said layers comprises a blend of cellulosic material with material selected from the group consisting of polyethylene, polypropylene, polyester, polyethylene terephthalate or combinations thereof.

16. The device of claim 1, wherein said low density layer has a percent absorbency of less than 10 percent.

17. The device of claim 1, wherein said low density layer has a dry resiliency less than 10 percent.

18. The device of claim 1, wherein said low density layer has a wet resiliency less than 10 percent.

19. The device of claim 1, wherein said cleaning composition is approximately 1 to 20 percent by weight of the total device weight.

20. The device of claim 1, wherein said substrate is attached to a handle.

21. The device of claim 1, wherein said cleaning composition comprises an acid selected from the group consisting of an organic hydroxy acid, a keto acid, or combinations thereof.

22. The device of claim 21, wherein said cleaning composition comprises citric acid.

* * * * *